US006358597B1

(12) United States Patent
Krauter

(10) Patent No.: US 6,358,597 B1
(45) Date of Patent: Mar. 19, 2002

(54) THERMO-TRANSFER RIBBON

(75) Inventor: Heinrich Krauter, Turriff (GB)

(73) Assignee: Pelikan Produktions AG, Egg (CH)

( * ) Notice: Subject to any disclaimer, the term of this patent is extended or adjusted under 35 U.S.C. 154(b) by 0 days.

(21) Appl. No.: 09/306,367

(22) Filed: May 6, 1999

Related U.S. Application Data

(63) Continuation-in-part of application No. 08/906,631, filed on Aug. 7, 1997, now Pat. No. 5,985,422.

(30) Foreign Application Priority Data

May 8, 1998 (DE) ..... 198 20 769

(51) Int. Cl.[7] ..... B41M 5/10

(52) U.S. Cl. ..... 428/195; 428/484; 428/488.1; 428/488.4; 428/914

(58) Field of Search ..... 428/198, 212, 428/484, 488.1, 488.4, 913, 914

(56) References Cited

U.S. PATENT DOCUMENTS

| | | | | |
|---|---|---|---|---|
| 4,592,945 A | * | 6/1986 | Mecke et al. | 428/195 |
| 4,877,681 A | | 10/1989 | Hanada et al. | |
| 4,938,617 A | * | 7/1990 | Mecke et al. | 400/241.4 |
| 5,118,211 A | | 6/1992 | Mecke et al. | |
| 5,219,610 A | * | 6/1993 | Koshizuka et al. | 427/152 |
| 5,292,572 A | | 3/1994 | Koshizuka et al. | |
| 5,827,617 A | | 10/1998 | Krauter | |
| 5,985,422 A | * | 11/1999 | Krauter | 428/212 |

FOREIGN PATENT DOCUMENTS

| | | | | |
|---|---|---|---|---|
| DE | 38 25 437 C1 | | 11/1989 | |
| DE | 195 48 033 A1 | | 7/1997 | |
| DE | 195 48 033 A | | 7/1997 | |
| DE | 196 12 393 A1 | | 10/1997 | |
| EP | 01 33 638 B1 | | 6/1984 | |
| EP | 0 420 132 A2 | | 4/1991 | |
| EP | 823 332 | * | 2/1998 | B41M/5/38 |

* cited by examiner

*Primary Examiner*—Bruce H. Hess
*Assistant Examiner*—Michael E. Grendzynski
(74) *Attorney, Agent, or Firm*—Fay, Sharpe, Fagan, Minnich & McKee, LLP

(57) ABSTRACT

A description is given of a thermo-transfer ribbon having a customary carrier, with a wax-bonded layer of a thermo-transfer color formed on one side of the carrier, and a resin-bonded separation layer located between carrier and wax-bonded layer, characterized in that at least the resin-bonded separation layer A) contains a wax-soluble polymer and the wax-bonded layer B) of the thermo-transfer color contains less than approximately 8% by weight, specifically 0 to approximately 5% by weight, of wax-soluble polymer, whereby the waxes of the wax-bonded layer B) are narrowly cut waxes with melting- and coagulation points positioned in close proximity to each other. The benefits of said thermo-transfer color consist in that there occur no differences in the quality of the print, either with "cold" or "hot" print, and specifically also on uncoated paper with high degree of roughness.

28 Claims, No Drawings

THERMO-TRANSFER RIBBON

The present application is a continuation-in-part application of U.S. application Ser. No. 08/906,631, filed on Aug. 7, 1997, now U.S. Pat. No. 5,985,422.

The invention relates to a thermo-transfer ribbon having a customary carrier with a wax-bonded layer of a thermo-transfer color formed on one side of the carrier and a resin-bonded separation layer arranged between the carrier and wax-bonded layer.

A thermo-transfer ribbon of the above described type is known from DE 195 48 033 A1. The wax-bonded separation layer described in same improves separation of the wax-bonded layer from the respective carrier. It is the particular goal of said teaching to exclude the necessity of forming a so-called "top coat" (adhesive layer) or a dual-layered thermo-transfer color, and to achieve satisfactory matt print-outs during the thermo-print process. This is assured in that both the wax-bonded separation layer as well as the wax-bonded layer of the thermo-transfer color contain a wax-soluble polymer in sufficiently large quantity. It is specifically preferred that the wax-bonded layer of the thermo-transfer color contains approximately 5 to 10% by weight of wax-soluble polymer.

The above described thermo-transfer ribbon is to a high degree suitable for satisfying the addressed goal. However, if the targeted goals are different, it requires improvement. This applies specifically with respect to thermo-transfer print on uncoated paper ("plain paper"), which has a comparatively high degree of roughness. The following physical properties are absolutely indispensable for good print quality and for quality products: The force of mechanical anchoring of the thermo-transfer color on the printed paper during separation in the thermo-printer—separation of ribbon from paper—must be greater than the cohesion of the thermo-transfer color itself and the adhesion of the thermo-transfer color to the substrate, i.e. less application of color, low color viscosity and low adhesion of the color vis-a-vis the separation layer (release layer) during the printing process lead to optimal print quality. Furthermore, state of the art products demonstrate that unwelcome variations in print quality occur with a "cold" and "hot" print head.

The invention is therefore based on the object of suggesting a thermo-transfer ribbon of the above-identified type, with which the earlier addressed goals are achieved with respect to improvement of the print quality, specifically with "cold" or "hot" print, specifically also on uncoated paper having a high degree of roughness.

According to the invention, said object is solved in that at least the resin-bonded separation layer A) contains a wax-soluble polymer and that the wax-bonded layer B) of the thermo-transfer color contains less than approximately 8% by weight, specifically approximately 0 to 5% by weight of wax-soluble polymer, whereby the waxes of the wax-bonded layer B) constitute narrowly cut waxes with melting- and coagulation points separated by only a narrow gap. Consequently, the wax-bonded layer B) contains no significant amounts of wax-soluble polymer, specifically approximately 0 to 1.5% by weight or even less than approximately 0.5% by weight.

In the present specialized field, the term "separation layer" or "release layer" means a layer which regulates the transfer of thermo-transfer color to the receiving substrate during the printing process, but which itself is not being transferred to the substrate. A separation layer does not melt during the printing process, but which, at most, softens and has, in addition, high adhesive property vis-a-vis the carrier.

One essential aspect with respect to solving the identified object is the use of "narrowly cut" waxes in the wax-bonded layer, in other words, melting point and coagulation point must lie close together. The temperature difference between melting point and coagulation point is in this case less than approximately 10° C., specifically less than approximately 7° C. and, most particularly preferred, less than approximately 5° C.

The waxes employed within the scope of the invention in the wax-bound layer B) of the thermo-transfer color are in line with the customary definition for wax, subject to the above limitation of restriction to narrowly cut waxes. Waxes with a melting point of approximately 75 to 90° C. are specifically employed within the scope of the invention. In the broadest sense, this involves material which is solid to brittle hard, coarse to finely crystalline, transparent to opaque, of relatively low viscosity without being stringy just slightly above the melting point. Waxes of this type are classified as natural waxes, chemically modified waxes and synthetic waxes.

Specifically preferred among the natural waxes are vegetable waxes in form of carnauba wax, candelilla wax, mineral waxes in form of higher-melting ceresin and higher-melting ozocerite (earth wax), petro-chemical waxes, such as for example petrolatum, paraffin waxes and micro-waxes. Preferred among the chemically-modified waxes are in particular montan-ester waxes, hydrated castor oil and hydrated jojoba oil. Preferred among the synthetic waxes are polyalkylene-waxes and polyethylene-glycol waxes, including products made from same via oxidation and/or esterification. Amide-waxes can likewise be utilized. To be mentioned here as particularly preferred are modified micro-crystalline waxes.

The melting point parameters to be observed for the utilized waxes according to the invention is critical. If the value falls below 70° C. that means that the mechanical anchoring is inadequate and color transfer and color resolution fail to satisfy. Higher melting points than approximately 95° C. adversely result in higher energy expenditure during the printing process.

The carnauba wax constitutes a good example for an employable wax according to the invention, with melting point at approximately 85° C. and coagulation point at approximately 78° C.

The specified waxes result in desirable low cohesion during the printing process of the thermo-transfer color. Multiple additives can be incorporated into the wax materials of the wax-bonded thermo-transfer color, such as specifically tackifiers in form of terpene phenol resins (such as, for example, the commercial products Zonatac lite 85 made by Arizona Chemical) and hydrocarbon resins (such as, for example, the commercial products KW-resin 61 B1/105 made by VFT, Frankfurt).

An adhesive layer with tackifier can be applied on layer B). In one specific embodiment, an adhesive layer is positioned on layer B), specifically a paraffin layer with a contents of finely distributed tackifying hydrocarbon resin, with the paraffin having a melting point of specifically 60 to 95° C.

Tinting can be done by any coloring substances. These may involve pigments, at a temperature of 100° C., such as specifically carbon black, but also solvent-soluble and/or binder-soluble coloring substances, like the commercial product Basoprint, organic color pigments as well as various azo dies (Cerces- and Sudan dies). Carbon black is considered as particularly suitable within the scope of the present invention. The thermo-transfer color preferably contains the coloring substance, specifically pigment, in a volume of approximately 5 to 20% by weight. The melting point of the wax-bonded thermo-transfer color lies generally between approximately 60 and 80° C.

The thermo-transfer color of the above specified layer B) of the thermo-transfer ribbon according to the invention—if applicable with the aforementioned additives—preferably has a viscosity of approximately 50 to 150 mPaos, specifically of 70 to 120 mPaos—determined at a temperature of 100° C. with a rheograph by means of rotation viscometer Rheomat 30 (Principle: rotation viscometer, see Bulletin T-304d-7605 of Messrs. Contraves AG Zuerich/Switzerland). Falling below the value of approximately 50 mPaos results in loss of sharpness ("spreading"). If the value of 250 mPaos is surpassed, deterioration with respect the desired resolution may occur.

A central characteristic of the thermo-transfer ribbon according to the invention consists in that layer A) mainly contains a wax-soluble polymer. The term "wax-soluble" in this context means that this polymer is soluble in liquid wax. This does not necessarily involve "genuine solutions", but mostly stable dispersions. The result is that during the cooling of such polymer solution in wax, there will be no phase separation or that said polymer is compatible with the wax. The melting index MFI lies at 25 to 1000 g/10 min (220° C./2.16 kg) preferably at 400 to 800 g/10 min (DIN 537735/ISO 1133, see also Roempp Chemical Lexicon, Volume 5, 9th edition, page 4036, right hand column). Wax-soluble polymers, according to the sense of the invention, distinguish themselves in that they melt below approximately 100° C. and that they are tacky in liquefied state. Suitable polymers are, for example, ethylene-vinylacetate -co-polymers, polyamides, ethylene-alkylacrylate-co-polymers, ethylene-acrylic acid-co-polymers, polyvinyl-ether and polyisobutene, including ionomer-resins. Particularly preferred among these are ethylene-acrylic acid-co-polymers and ethylene-vinylacetate-co-polymers (EVA). With employment of ethylene-vinylacetate-co-polymers, a vinylacetate contents of approximately 16 to 42% by weight is preferred, specifically of approximately 18 to 40% by weight in order to increase the adhesion between the separation layer A) and layer B). The melting index MFI (according to DIN 53735) of the ethylene-vinylacetate -co-polymer should lie above approximately 20 g/10 min, specifically above approximately 30 g/10 min (220° C./2.16 kg).

For a low adhesion setting between the separation layer A) and the layer B), the ethylene-vinylacetate-co-polymer preferably has a vinylacetate contents of approximately 3 to 17% by weight, specifically approximately 6 to 12% by weight.

The term "wax-soluble polymers" includes also polymers which already show a certain tackiness at room temperature, such as for example poly-isobutenes with oily, tough-sticky to caoutchouc-like consistency. Such products are marketed under the tradename Oppanol (BASF, Germany—compare Roempp Chemical Lexicon 9th edition, volume 4, page 3121/3122).

Among these, at room temperature sticky, water-soluble polymers are also raw materials on the basis of polyvinylethyl, -methyl, and -isobutylether, which are distributed under the tradename Lutonal (BASF, Germany, compare Roempp Chemical Lexicon, 9th edition, volume 3, page 2566).

A particular characteristic of the present invention is the shifting of the main quantity of the discussed wax-soluble polymer from layer B) to the separation layer A). The wax-soluble polymers can be employed singly or in mixed combination. It is possible to employ identical or different wax-soluble polymers in the separation layer A) and, if present, also in layer B).

In the separation layer A), the wax-soluble polymer is preferably present in a volume of approximately 10 to 60% by weight, specifically approximately 20 to 40% by weight. If the value falls below 10% by weight, then the adhesion of the color layer is too high and there is no assurance with respect to homogeneous color transfer. A value of more than 60% by weight results in insufficient adhesion to the color layer and, consequently, in poor resolution of the printed symbols.

The shifting of the principal volume from the thermo-transfer color to the separation layer of the wax-soluble polymer, specifically in form of ethylene-vinylacetate-co-polymer, produces a relative low viscosity when quite a lot of ester wax (melting point>80° C.) is employed. The resulting lower viscosity and good carbon black dispersivity in ester waxes permits higher concentration of pigment, specifically carbon black, and, consequently, lower color application (g/m$^2$) with equal surface cover capability.

The separation layer A) containing the principal portion of wax-soluble polymers also fulfills the function of a "matt layer". As a result of the matt layer, truly matt print-outs are being produced during the thermo-print process. This is based on the circumstance that it is not only the thermo-transfer color which turns liquid during the printing process, thereby adhering to the substrate, specifically in form of a paper acceptor, but that the separation layer softens as well and retains perceptible adhesion to the color layer, so that for example, full flat transfer of print symbols to the paper acceptor is not possible. Instead, the surface of the printed symbols is roughened a little, so that the surface of the transferred symbols appears matt (dull) as a result of light refraction/light diffusion.

The "matting" effect is further promoted if layer B) contains black pigment and the separation layer additionally contains carbon black, specifically in a volume of approximately 20 to 50% by weight, which results in the used-up thermo-transfer ribbon affording sufficient data protection. With this beneficial embodiment of the present invention, silicic acid and auxiliary dispersants are preferably also incorporated into the separation layer. As a result, the carbon black remains finely distributed in the layer during the formation of the layer—it does not settle down.

In another embodiment the "printing noise" can be regulated by addition of polyether-alcohols to the separation layer A) (release of the ribbon from the paper after the printing process). For that purpose, the separation layer A) contains separation substances in volume of approximately 5 to 30% by weight, whereby said substances are present in form of non-ionic tensides, emulsifying agents, polyethylene-glycoles, etc.

The application thickness of the separation layer A) and of layer B) is not critical. The separation layer A) preferably has an application thickness of approximately 0.2 to 5 g/m$^2$, specifically approximately 1 to 3 g/m$^2$, and layer B) an application thickness of approximately 1.0 to 10 g/m$^2$, specifically approximately 3 to 6 g/m$^2$. With respect to the separation layer A), this is a resin-bonded layer, whereby the resin binding agent is preferably a solid resin, having a softening range within the framework of approximately 50 to 200° C. The resin preferably comprises alkyd-, epoxide-, melamine-, phenol-, urethane- and/or polyester or co-polyester resins and/or a polyamide, hydrocarbon resin, natural resin, polyvinylether and/or polyisobutene.

The carrier of the color ribbon according to the invention is not critical. Polyethylene-terephthalate foils (PETP) or capacitor tissues are preferably used as basic foil for the thermo-transfer ribbons.

The selection parameters are highest possible tension/elongation values and thermal stability with small foil thickness. PETP foils can be obtained as thin as approximately 2.5 μm, capacitor paper as thin as approximately 6 μm. During the printing process, the thermo print head reaches temperatures of up to 400° C., i.e. temperatures which lie above the softening point of PETP. If PETP foils are employed, it is suggested that a layer of particularly heat-resistant material be provided on the reverse side of the foil that comes into contact with the thermo head.

A beneficial refinement of the inventive idea, specifically for obtaining a beneficially sharp-edged print, is based on an incorporation of the teaching of EP-B-0 133 638. Accordingly, on the reverse side of the carrier, a layer is formed made of wax or a wax-like material, specifically with a thickness of not more than approximately 1 μm and most specifically preferred in form of a molecularly shaped layer, having a thickness of approximately 0.05 to 0.10 μm. The coating material in this case preferably consists of paraffin, silicone, natural waxes, specifically carnauba wax, bees wax, ozocerite and paraffin wax, synthetic waxes, specifically acid waxes, ester waxes, partially saponified ester waxes and polyethylene waxes, glycoles or polyglycole, antistatic substances and/or tensides. If such coating is provided on the reverse side, then undisturbed heat transfer takes place from the thermo print head to the thermo-transfer ribbon, resulting in particularly sharp-edged prints.

For obtaining optimal print quality when employing the thermo-transfer ribbon according to the invention in fax machines, it is suggested that a so-called four-layer-structure be developed in the following sequential order and with the approximate following layer thickness: Top coat (adhesive layer) approximately 0.5 to 0.7 g/m$^2$, wax-bonded layer of the thermo-transfer color B)—approximately 4.0 to 4.5 g/m$^2$, separation layer A)—approximately 0.5 to 1.0 g/m$^2$, thickness of the carrier (for example polyethylene-terephthalate) approximately 4.0 to 5.0 μm, reverse side coating (anti-adhesive layer) approximately 0.05 to 0.1 g/m$^2$. In order to concurrently obtain higher temperature resistance during storage, it is appropriate to work into the thermo-transfer color and with respect to the four-layer product into the top coat, a higher melting wax having a melting point of at least 80° C., specifically >85° C.

The thermo-transfer ribbon according to the invention described above can be manufactured in many ways using customary application processes. It can be done, for example, by spraying on or printing on a solution or dispersion, either with water or an organic solvent as dispersion or dissolution agent, by application from melted state, which applies particularly with respect to the wax-bonded thermo-transfer color, or also by normal application via wiper-blade in form of a watery suspension with finely distributed coating material therein.

From an environmental protection aspect, the following method has been proven as particularly beneficial: To start with, a watery suspension of the raw materials of the separation layer are applied in a thin coating on the carrier, which, upon evaporation of the water, permits the formation of the separation layer A). The formation of the separation layer A) is followed by an application of a watery suspension of the raw material of the wax-bonded thermo-transfer color, with the water being evaporated in customary fashion, after application of this material. The developed double-layered coating satisfies all requirements within the scope of the specified object. It is, however, also possible to apply the thermo-transfer color onto the separation layer in form of melted material according to customary application technologies, for example with a wiper-blade. The temperature of the respective melt should generally range between 100 and 130° C. After the coating, the applied materials are permitted to simply cool down.

For the practical or particularly beneficial realization of the present invention, the following basic conditions can be specified with respect to application volumes of the individual layers or their application thickness: Thermo-transfer layer B) approximately 1 to 10 g/m$^2$, preferably approximately 3 to 6 g/m$^2$, separation layer A) 0.2 to 5 g/m$^2$, preferably approximately 0.5 to 1.5 g/m$^2$, carrier film, specifically polyester film with a thickness of approximately 2 to 8 μm, specifically with a thickness of approximately 4 to 5 μm, including reverse side coating with an application thickness of approximately 0.01 to 0.2 g/m$^2$, specifically of approximately 0.05 to 0.1 g/m$^2$.

The benefits related to the invention must be seen specifically in that the beneficial prints can also be made on uncoated and consequently rough paper, whereby higher resolution is achieved, specifically when employed in fax machines. There is no difference in the quality of the print with either "cold" or "hot" print. Other benefits with respect to the thermo-transfer ribbons accrue from enhanced temperature resistance and improved shelf-life (T>50° C. ), as well as reduced print noise and from the 100% antistatic finish resulting from embedding conductive carbon black into the separation layer. These benefits are specifically obtained in that the wax-soluble polymer,—specifically the preferably employed ethylene-vinylacetate-co-polymerisate—is shifted from the thermo-transfer color B) into the separation layer A) and that with the aid of incorporating separation means into the separation layer A), control of print noise is achieved.

In the following, the invention is explained in more detail, making use of examples:

EXAMPLE 1

On a customary carrier of polyester, having a layer thickness of approximately 6 μm, a material according to the following recipe is applied via wiper-blade for the formation of the separation layer A):

| | |
|---|---|
| Polyester resin | 40% by weight |
| wax-soluble polymer (EVA) | 30% by weight |
| carbon black | 29% by weight |
| silicic acid | 1% by weight |
| | 100% by weight |

The above material is applied in a solvent dispersion (approximately 15%, in toluol/isopropanol 80:20) with a thickness—when dry—of approximately 1.0 μm. Evaporation of the solvent is done via passage of hot air at a temperature of approximately 100° C. Subsequently the thermo-transfer color B), according to the following recipe, is applied by means of flexo-pressure, in form of a melt, having a temperature of approximately 105° C.,

| Recipe (3-layer version): | |
|---|---|
| ester wax | 50% by weight |
| paraffin wax | 25% by weight |
| EVA 28/800 | 5% by weight |
| Petrolite[R] WB 17 | 5% by weight |
| coloring carbon black | 15% by weight |
| | 100% by weight |

EXAMPLE 2

Example 1 was repeated, but with the modification of using the following recipes for the separation layer A) and for the color layer B):

| Separation Layer A): | |
|---|---|
| Polyester resin | 25% by weight |
| wax-soluble polymer EVA | 40% by weight |
| polyether alcohol | 10% by weight |
| color pigments | 15% by weight |
| | 100% by weight |
| Transfer color layer B) (4-layer version): | |
| micro-crystalline wax | 30% by weight |
| paraffin wax | 33% by weight |
| EVA 28/800 | 4% by weight |
| Petrolite[R] WB 17 | 15% by weight |
| colored carbon black | 18% by weight |
| | 100% by weight |

What is claimed is:

1. Thermo-transfer ribbon having a carrier, with a wax-bonded layer of a thermo-transfer color formed on one side of the carrier, and with a resin-bonded separation layer, wherein at least the resin-bonded separation layer A) contains a wax-soluble polymer and the wax-bonded layer B) of the thermo-transfer color contains less than 8% by weight of wax-soluble polymer, the thermo-transfer color including a color pigment having a volume of from about 5 to 20% by weight, whereby waxes of the wax-bonded layer B) include melting- and coagulation points separated by less than 10° C.

2. Thermo-transfer ribbon according to claim 1, characterized in that the difference between melting- and coagulation point of the narrowly cut waxes amounts to less than 10° C.

3. Thermo-transfer ribbon according to claim 1, characterized in that the melting point of the waxes of the thermo-transfer color lies between approximately 75 and 90° C.

4. Thermo-transfer ribbon according to claim 1, characterized in that the separation layer A) contains approximately 10 to 60% by weight of wax-soluble polymer.

5. Thermo-transfer ribbon according to claim 1, characterized in that the thermo-transfer color of layer B) has a viscosity of approximately 50 to 150 mPaos, measured with a rotation viscometer at 100° C.

6. Thermo-transfer ribbon according to claim 1, characterized in that the waxes of layer B) are natural waxes in form of carnauba wax and candelilla wax, chemically modified waxes or hard waxes in form of modified, micro-crystalline was, ester waxes, paraffin waxes and/or synthetic waxes in form of Fischer-Tropsch wax or polyethylene wax.

7. Thermo-transfer ribbon according to claim 1, characterized in that the wax-soluble polymer is an ethylene-vinylacetate-co-polymer, an ethylene-acrylic acid-co-polymer, a polyamide, a polyvinyl-ether, a poly-isobutene and/or an ionomer resin.

8. Thermo-transfer ribbon according to claim 7, characterized in that for purposes of increased adhesion between separation layer A) and layer B), the ethylene-vinylacetate-co-polymer has a vinyl-acetate contents of approximately 16 to 42.

9. Thermo-transfer ribbon according to claim 8, characterized in that the melting index MFI (according to DIN 53735) of the ethylene-vinylacetate-co-polymer lies above 20 g/10 min.

10. Thermo-transfer ribbon according to claim 8, characterized in that the ethylene-vinylacetate-co-polymer has a vinyl-acetate contents from approximately 3 to 17 by weight for low adhesion adjustment between the separation layer A) and layer B).

11. Thermo-transfer ribbon according to claim 1, characterized in that the resin of the separation layer A) constitutes a solid resin with a softening range of approximately 70 to 200° C.

12. Thermo-transfer ribbon according to claim 11, characterized in that the resin includes an alkyd-, epoxide-, melamine-, phenol-, urethane- and/or polyester resin and/or a polyamide, hydrocarbon resin and/or natural resin.

13. Thermo-transfer ribbon according to claim 1, characterized in that the separation layer A) has an thickness of approximately 1 to 10 g/m$^2$.

14. Thermo-transfer ribbon according to claim 1, characterized in that the layer B) of the thermo-transfer color has an thickness of approximately 1 to 10 g/m$^2$.

15. Thermo-transfer ribbon according to claim 1, characterized in that the color pigment is carbon black.

16. Thermo-transfer ribbon according to claim 1, characterized in that the separation layer A) additionally contains conductive carbon black, color pigment, auxiliary dispersants and/or silicic acid.

17. Thermo-transfer ribbon according to claim 1, characterized in that the separation layer A) contains specific separation substances in a volume of approximately 5 to 20% by weight.

18. Thermo-transfer ribbon according to claim 17, characterized in that the separation substances are present in form of non-ionic tensides, emulsifiers and/or polyethylene-glycols.

19. Thermo-transfer ribbon according to claim 1, characterized in that the melting point of the wax-bonded thermo-transfer color lies between approximately 60 and 80° C.

20. Thermo-transfer ribbon according to claim 1, characterized in that on layer B) there is arranged an adhesion layer, specifically a paraffin layer, with a contents of finely distributed, tackifying hydrocarbon resin, whereby the paraffin has a melting point of specifically approximately 60 to 95° C.

21. Thermo-transfer ribbon according to claim 1, characterized in that a thin layer of wax or wax-like material is located on the reverse side of the carrier, having a specific thickness of not more than 1 $\mu$m.

22. Thermo-transfer ribbon according to claim 1, characterized in that the difference between melting- and coagulation point of the narrowly cut waxes amounts to less than 7° C.

23. Therm-transfer ribbon according to claim 1, characterized in that the separation layer A) contains approximately 20 to 40% by weight of wax-soluble polymer.

24. Thermo-transfer ribbon according to claim 1, characterized in that the thermo-transfer color of layer B) has a viscosity of approximately 70 to 120 mPaos, measured with a rotation viscometer at 100° C.

25. Thermo-transfer ribbon according to claim 7, characterized in that for purposes of increased adhesion between separation layer A) and layer B), the ethylene-vinylacetate-co-polymer has a vinyl-acetate contents of approximately 18 to 40% by weight.

26. Thermo-transfer ribbon according to claim 8, characterized in that the melting index MFI (according to DIN 53735) of the ethylene-vinylacetate-co-polymer lies above 30 g/10 min (220° C./2.16 kg).

27. Thermo-transfer ribbon according to claim 8, characterized in that the ethylene-vinylacetate-co-polymer has a vinyl-acetate contents from approximately 6 to 12% by weight for low adhesion adjustment between the separation layer A) and layer B).

28. Thermo-transfer ribbon according to claim 1, characterized in that the layer B) of the thermo-transfer color has an application thickness of approximately 3 to 6 $g/m^2$.

* * * * *